US009589442B2

(12) United States Patent
Barfield, Jr. et al.

(10) Patent No.: US 9,589,442 B2
(45) Date of Patent: Mar. 7, 2017

(54) ADAPTIVE CLASSIFICATION OF FALL DETECTION FOR PERSONAL EMERGENCY RESPONSE SYSTEMS

(71) Applicant: HTI IP, L.L.C., Arlington, VA (US)

(72) Inventors: James Ronald Barfield, Jr., Atlanta, GA (US); Stephen Christopher Welch, Atlanta, GA (US)

(73) Assignee: Verizon Telematics Inc., Atlanta, GA (US)

( * ) Notice: Subject to any disclaimer, the term of this patent is extended or adjusted under 35 U.S.C. 154(b) by 734 days.

(21) Appl. No.: 14/016,434

(22) Filed: Sep. 3, 2013

(65) Prior Publication Data

US 2015/0061863 A1 Mar. 5, 2015

(51) Int. Cl.

| | |
|---|---|
| ***G08B 21/04*** | (2006.01) |
| *G08B 25/01* | (2006.01) |
| *G08B 25/00* | (2006.01) |

(52) U.S. Cl.

CPC ..... *G08B 21/0446* (2013.01); *G08B 21/043* (2013.01); *G08B 25/001* (2013.01); *G08B 25/016* (2013.01)

(58) Field of Classification Search

None

See application file for complete search history.

(56) References Cited

U.S. PATENT DOCUMENTS

| | | | | |
|---|---|---|---|---|
| 7,133,856 | B2 * | 11/2006 | Huang | G06K 9/6282 700/104 |
| 2009/0224925 | A1 * | 9/2009 | Gannot | A61B 5/1117 340/573.1 |
| 2011/0230791 | A1 * | 9/2011 | Ten Kate | G08B 21/0446 600/595 |
| 2012/0083237 | A1 * | 4/2012 | Fish | H04M 1/72538 455/404.1 |
| 2013/0172691 | A1 * | 7/2013 | Tran | A61B 8/488 600/301 |
| 2014/0313036 | A1 * | 10/2014 | Sweeney | G08B 21/0446 340/573.1 |

OTHER PUBLICATIONS

Author unknown; Lifecomm Brochure: "Lifecomm Expanding Your World: Next Generation Mobile Personal Emergency Response System," Printed Aug. 30, 2013.

* cited by examiner

*Primary Examiner* — Mohamed Barakat

(57) ABSTRACT

Techniques described herein relate to the classification of fall events for PER (personal emergency response) devices. In one implementation, data relating to acceleration events that occurred at the PER devices may be received. The data relating to the acceleration events may be associated with indications of whether the acceleration events correspond to fall events of users of the PER devices. A classification model may be trained based on the data relating to the acceleration events and the indications of whether the data relating to the acceleration events corresponds to the fall events. The classification model may be transmitted to at least some of the PER devices to update a previous version of the classification model at the at least some of the PER devices.

19 Claims, 15 Drawing Sheets

500

Acceleration Event Data

| Device-specific Data | | | | User-specific Data | | | | |
|---|---|---|---|---|---|---|---|---|
| Max Acceleration (g's) | Window 1 Energy | Window 2 Energy | Post Event Activity | Age | Previous Falls | Previous False Positives | Medical Conditions | Assistance Devices |
| 2.6 | 201 | 250 | 2 | 75 | 0 | 0 | Hip Relacement | Walker |
| 2.6 | 222 | 251 | 2 | 71 | 0 | 0 | Heart Disease | Walker |
| 2.1 | 501 | 600 | 1 | 65 | 0 | 0 | None | Cane |
| 1.8 | 430 | 530 | 2 | 70 | 0 | 3 | Lung Disease | None |
| 2.4 | 310 | 231 | 3 | 71 | 0 | 1 | None | None |
| 2.4 | 450 | 503 | 3 | 64 | 1 | 4 | None | Scooter |
| 2.1 | 501 | 403 | 1 | 78 | 2 | 2 | Hip Relacement | Scooter |
| 1.5 | 300 | 501 | 2 | 74 | 0 | 0 | None | Cane |
| 2.8 | 610 | 502 | 0 | 76 | 0 | 0 | None | None |
| 4 | 301 | 252 | 0 | 95 | 0 | 0 | Diabetic | None |

Fig. 5A

550

Acceleration Event Data

| Device-specific Data | | | | User-specific Data | | | | |
|---|---|---|---|---|---|---|---|---|
| Max Acceleration (g's) | Window 1 Energy | Window 2 Energy | Post Event Activity | Age | Previous Falls | Previous False Positives | Medical Conditions | Assistance Devices |
| 2.2 | 198 | 150 | 3 | 64 | 0 | 1 | None | Cane |
| 1 | 150 | 106 | 5 | 54 | 0 | 2 | None | Cane |
| 1.2 | 190 | 204 | 4 | 76 | 0 | 0 | None | Cane |
| 1.4 | 204 | 234 | 3 | 55 | 0 | 1 | Heart Disease | None |
| 5 | 280 | 320 | 2 | 78 | 0 | 0 | None | Walker |
| 1.8 | 240 | 123 | 4 | 78 | 0 | 1 | Lung Disease | Walker |
| 5 | 310 | 324 | 5 | 87 | 1 | 0 | Hip Relacement | Scooter |
| 4 | 410 | 231 | 5 | 87 | 0 | 0 | Hip Relacement | None |
| 2.4 | 200 | 231 | 4 | 88 | 0 | 0 | Diabetic | None |
| 3 | 105 | 311 | 4 | 96 | 0 | 0 | Diabetic | None |

Fig. 5B

ADAPTIVE CLASSIFICATION OF FALL DETECTION FOR PERSONAL EMERGENCY RESPONSE SYSTEMS

BACKGROUND

Mobile personal emergency response systems (PERs) include devices designed to be worn by individuals, such as a device implemented in a bracelet or watch form factor, that provides services, such as automatic fall detection, to the user. PER devices may be particularly useful to the elderly or to other individuals who have a higher than normal chance of becoming incapacitated due to a fall or other accident. A PER device may include a wireless communication link and logic, such as an accelerometer and an associated control circuit, to automatically detect falls.

In the event of an emergency, such as an automatically detected fall or a user-triggered emergency (e.g., a user pressing a "talk" or "communicate" button), the PER device may place a call to an emergency operator, who may evaluate the situation and determine an appropriate response, such as requesting an ambulance for the user. For example, in response to the automatic detection of a potential fall by the user (e.g., the wearer of the PER device), the PER device may place a call to an emergency operator. If the emergency operator is unable to communicate with the user, or the user indicates that there is a problem (e.g., the user has fallen and can't get up), the emergency operator may call for an ambulance or take other emergency action (e.g., call a neighbor or another designated emergency contact).

With a PER device, it can be important to be able to accurately detect fall events. Fall events that are not detected by the PER device may result in a failure to obtain emergency help for an injured user. Additionally, false positive fall events (i.e., events signaled by the PER device as a fall event but which are not fall events) can annoy the user and cause undue expense/strain on the communication infrastructure and/or the emergency response system.

BRIEF DESCRIPTION OF THE DRAWINGS

FIGS. 5A and 5B are diagrams illustrating example data structures;

DETAILED DESCRIPTION OF PREFERRED EMBODIMENTS

The following detailed description refers to the accompanying drawings. The same reference numbers in different drawings may identify the same or similar elements.

Techniques described herein relate to the classification of fall events for a PER device. The PER device may include an accelerometer and/or other sensors. The PER device may detect acceleration events based on spikes in acceleration magnitudes that are measured by the accelerometer. A classification model, such as a binary classification tree (BCT), may use the acceleration data and/or other data, such as data from other sensors or data relating to personal information about the user of the PER device (e.g., medical conditions of the user or other user-specific data) to classify the acceleration event as a fall or non-fall event. The classification model may be maintained or stored by a server that is remote with respect to the PER device.

Real-world data relating to acceleration events (e.g., the measured acceleration data and/or other sensed data) may be uploaded, from the PER device, to the server. Additionally, the server may receive information indicating whether the acceleration events actually correspond to fall or non-fall events. For example, if the user speaks to an emergency response operator and confirms that a fall has occurred, or a fall is confirmed in some other way (e.g., emergency response personnel confirm the user fell), an acceleration event may be stored by the server as a confirmed fall event. Conversely, in some situations, an acceleration event may be confirmed as a non-fall event. For example, the PER device may include a "cancel" button that a user may press to indicate that a fall has not occurred or the user may speak to an emergency response operator and indicate that a fall has not occurred. In this case, the data corresponding to the acceleration event may be stored by the server as a confirmed non-fall event.

The real-world data, relating to the classification of acceleration events obtained in the manner described above, may be used to adaptively update and improve the classification model(s) maintained by the server. The updated models may be downloaded, such as through a wireless network, to the PER devices. In this manner, the PER devices may include up-to-date classification models.

Additionally, in some implementations, the classification model that is transmitted to each PER device may be customized based on user-specific information. For example, a particular user's medical history and/or demographic information may be used to obtain a classification model that is customized for the particular user. The customized classification model may be transmitted to the PER device of the particular user.

Figure 1:
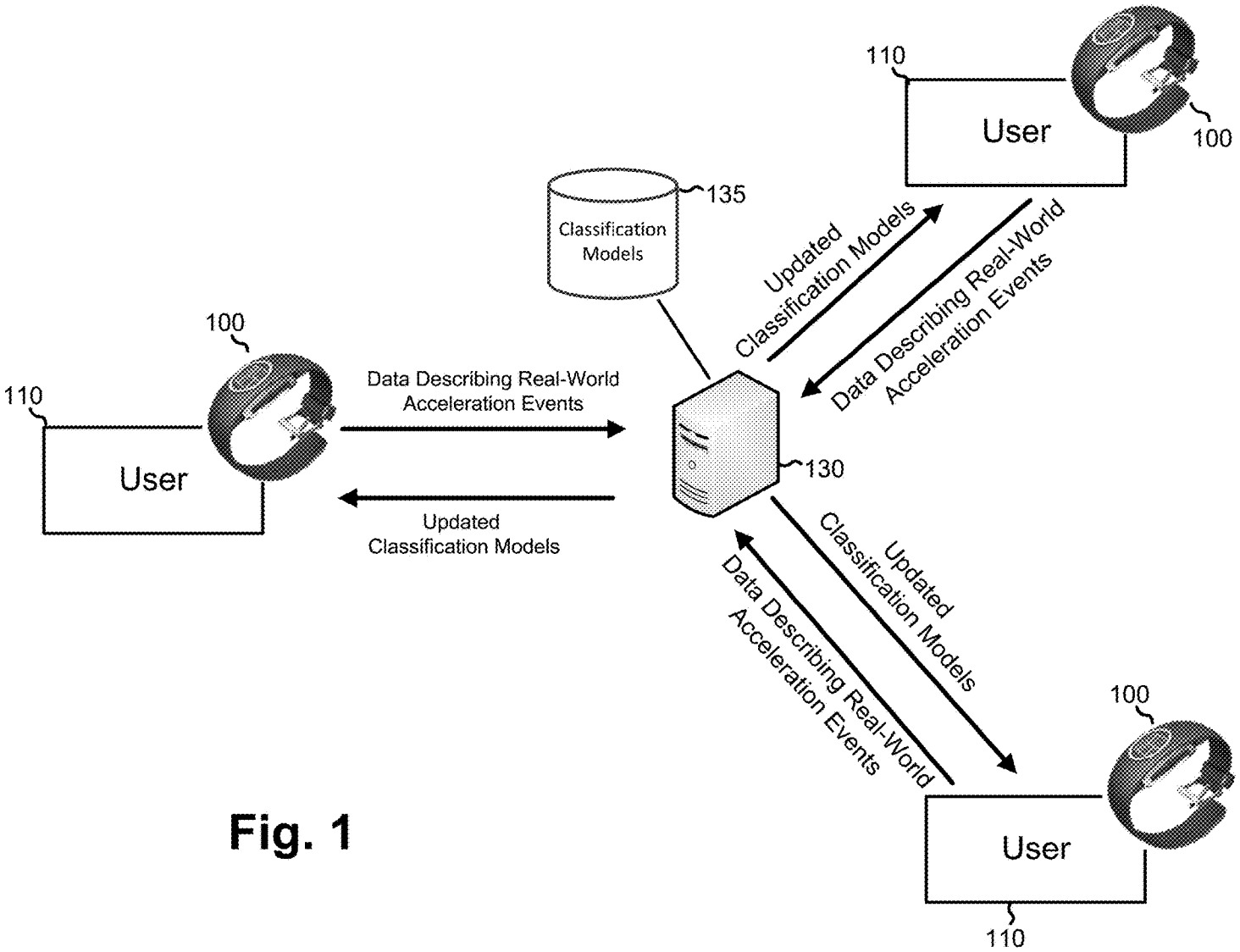
FIG. 1 is a diagram conceptually illustrating an example of an overview of concepts described herein.

FIG. 1 is a diagram conceptually illustrating an example of an overview of concepts described herein. PER devices 100, associated with a number of users 110 (e.g., worn on a wrist of the user 110 or otherwise carried by a user 110) may be operatively coupled (e.g., via a wireless network) to a server 130. PER devices 100 may each include an accelerometer and/or other sensors. Server 130 may maintain one or more classification models 135, such as models based on BCTs, to classify sensed acceleration events, as fall or non-fall events.

As illustrated in FIG. 1, data relating to acceleration events may be uploaded to server 130 ("Data Describing Real-World Acceleration Events"). Server 130 may use the data relating to the acceleration events, which may correspond to multiple users 110 and multiple PER devices 100, to occasionally or periodically update classification models 135. The updated classification models may be downloaded to PER devices 100 ("Updated Classification Models") to thus provide PER devices 100 with updated classification models. In this manner, classification models 135, used by PER devices 100, may be improved as additional data regarding real-world acceleration events are received by server 130.

In operation, PER devices 100 may use the updated classification models to determine whether acceleration events correspond to falls (or non-falls) of user 110. In the event of a fall, PER device 100 may, for example, contact an emergency response operator.

Figure 2:
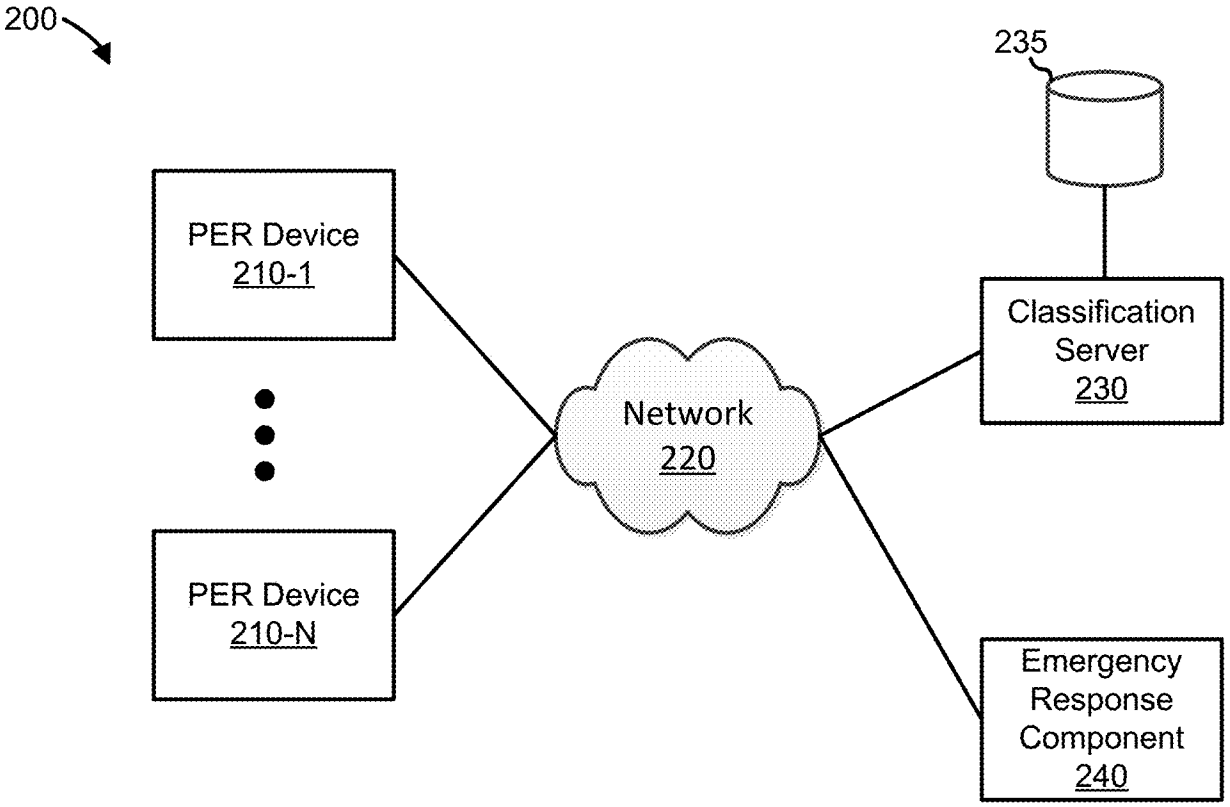
FIG. 2 is a diagram of an example environment in which systems and/or methods described herein may be implemented.

FIG. 2 is a diagram of an example environment 200, in which systems and/or methods described herein may be implemented. Environment 200 may correspond to an environment in which one or more PER devices are deployed.

As illustrated, environment 200 may include a number of PER devices 210-1 through 210-N (referred to herein collectively as PER devices 210 and/or individually as PER device 210), network 220, classification server 230, and emergency response component 240.

Each PER device 210 may correspond to a wearable computing device designed to provide assistance and monitoring for users (such as user 110, not illustrated in FIG. 2). As mentioned previously, a PER device 210 may include the ability to detect when a user falls and automatically report the fall to an emergency response operator. Detection of a fall or non-fall event may be based, at least in part, on acceleration measurements provided by an accelerometer. An example of a PER device 210 is described in more detail with reference to FIG. 3.

Network 220 may include one or more networks that act to operatively couple PER devices 210 to classification server 230 and/or emergency response component 240. Network 220 may include, for example, one or more networks of any type, such as a local area network (LAN), a wide area network (WAN), a metropolitan area network (MAN), and/or another type of network. In some implementations, network 220 may include packet-based Internet Protocol (IP) networks and connectivity to network 220 may be achieved through wireless connections (e.g., a cellular wireless network). For instance, network 220 may provide wireless connectivity for voice and data communications with PER devices 210.

Classification server 230 may include one or more computing devices, which may be centrally located or geographically distributed. Although referred to as a "server," classification server 230 may correspond to a traditional server, a cloud-based service, an application server, or another implementation that provides services and/or data storage relating to PER devices 210. Classification server 230 may be designed to receive data from PER devices 210 and provide data to PER devices 210. For example, data corresponding to acceleration events detected by a PER device 210 (e.g., acceleration measurements and potentially other sensed information) may be transmitted to classification server 230. Classification server 230 may maintain one or more classification models used to determine whether acceleration events correspond to a fall of the user of the PER device. Classification server 230 may transmit classification models to PER devices 210, which may then use a classification model, in real-time, to detect and report falls by the corresponding users of the PER devices. Further, the classification models may be reviewed by an expert or trained technician before being transmitted from classification server 230 to devices 210.

As illustrated in FIG. 2, classification server 230 may include or be associated with a database 235 (or other data structure), which may store the classification models and information that may be used to train the classification models. The stored information may include device-specific data and user-specific data. The device-specific data may particularly include acceleration data relating to acceleration events detected by accelerometers, such as accelerometers implemented by PER devices 210. In some implementations, the device-specific data may include other information detected by PER devices 210, such as barometric pressure, gyroscope data, proximity measurements, environmental temperature vales, blood pressure or heart rate values measured by PER devices 210, etc. The user-specific data may include medical data of the users (e.g., medical conditions), demographic information of the users (e.g., sex and age), and/or fall history of the users (e.g., a number of detected previous falls and a number of previous false positive fall detections).

Emergency response component 240 may include one or more devices or systems designed to provide emergency response services. For example, emergency response component 240 may be associated with a call center that employs operators trained to handle telephone calls from users that may require assistance. The operators may speak to the user that potentially requires assistance and/or may view device-specific or user-specific data that is reported by the corresponding PER device 210 of the user. Depending on the situation, the operator may take actions to assist the user, such as by calling for an ambulance, contacting a designated emergency contact for the user, or assisting the user in some other way.

Figure 3:
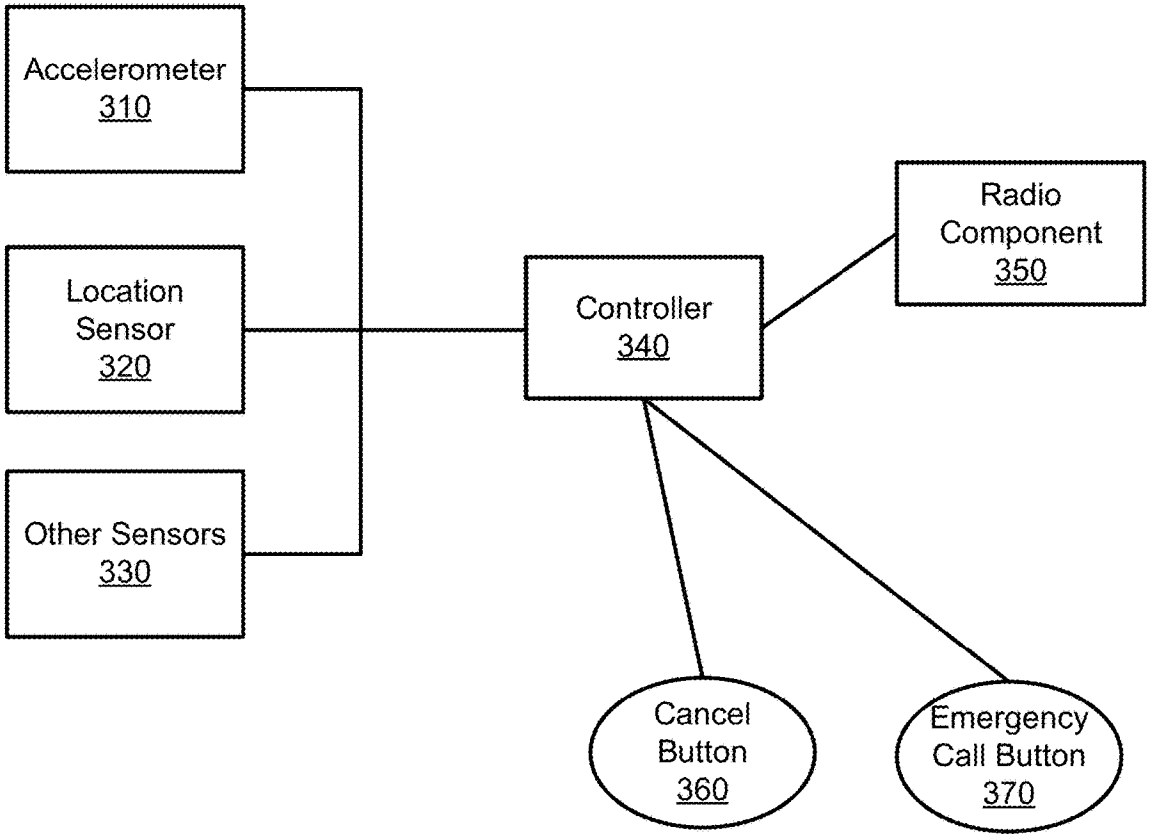
FIG. 3 is a diagram illustrating functional components corresponding to an example implementation of a PER device.

FIG. 3 is a diagram illustrating functional components corresponding to an example implementation of a PER device 210. As mentioned, in some implementations, PER device 210 may be designed as a wearable device (e.g., a bracelet or a band). In other possible implementations, PER device 210 may be implemented as software on another computing device, such as a smart phone that includes an accelerometer. As illustrated in FIG. 3, PER device 210 may include accelerometer 310, location sensor 320, other sensors 330, controller 340, radio component 350, cancel button 360, and call button 370.

Accelerometer 310 may be an accelerometer that measures proper acceleration. The acceleration, measured by accelerometer 310, may be output as three acceleration values corresponding to acceleration measured along three orthogonal axis (e.g., X, Y, and Z axes). Acceleration values may be received and acted upon by controller 340.

Location sensor 320 may include a global positioning sensor designed to determine the geographic location (e.g., latitude and longitude) of PER device 210. Location server 320 may include, for example, a global positioning system (GPS) sensor, a GLONASS-based sensor (a global navigation based satellite system that is an alternative to GPS), or other sensors for determining position. A location may be transmitted to classification server 230 and/or emergency response component 240, such as to assist in calling for emergency response personnel for a user that is in distress (e.g., has fallen). In some implementations, alternative or additional techniques may be used to determine the geographic location of PER device 210 (e.g., triangulation using cellular towers).

Other sensors 330 may represent any additional environmental sensors that may be implemented by PER device 210. In general, the additional sensors may include any sensors that may measure information that may be useful in the detection of falls. For example, the additional sensors may include barometric pressure sensors, gyroscopes, magnetometers, proximity sensors, temperature sensors, light sensors (e.g., photo diode sensors), altimeter sensors, infrared sensor, audio sensors, or sensors designed to detect a physical condition of a user (e.g., blood pressure, heart rate, glucose, variable heart rate, blood oxygen, or other sensors).

Controller 340 may include a microcontroller, processor, or another processing device or circuit used to control the operation of PER device 210. Controller 340 may additionally include or be communicatively coupled to computer readable media (e.g., a computer memory and/or another type of non-transitory computer-readable medium) that may store instructions for execution by controller 340. Controller 340 may additionally implement one or more classification models used to detect whether a user of PER device 210 has fallen. The classification models may be received, via network 220, from classification server 230. In operation, controller 340 may generally receive acceleration data from accelerometer 310, and potentially other data from other sensors 330. Controller 340 may use the received data as inputs to the classification models. Additionally, controller 340 may transmit the data received from accelerometer 310 and other sensors 330, to classification server 230.

Radio component 350 may include logic to manage a radio interface, such as a radio interface used to wirelessly connect to network 220. In one implementation, radio component 350 may provide an interface to a wireless cellular network. Radio component 350 may include one or more antennas and corresponding transceiver circuitry.

PER device 210 may additionally include one or more buttons through which a user may interact with PER device 210, such as cancel button 360. A user of PER device 210 may be instructed to press cancel button 360 when PER device 210 falsely detects a fall event. PER device 210 may indicate, to the user, the detection of a fall event, such as by playing a sound or providing a visual indication. When the user notices the indication of the fall event and the user does not need emergency assistance, the user may activate cancel button 360 to indicate that no emergency assistance is required. Emergency call button 370 may be used by the user, of PER device 210, to explicitly call for emergency assistance. Activating emergency call button 370 may, for example, initiate a telephone call with an emergency response operator (e.g., associated with emergency response component 240).

Although FIGS. 2 and 3 illustrate example components of an environment 200 and/or a PER device 210, respectively, in other implementations, environment 200 and/or PER device 210 may contain fewer components, different components, differently arranged components, or additional components than those depicted. Alternatively, or additionally, one or more of the depicted components may perform one or more other tasks described as being performed by one or more other ones of the depicted components.

In the operation of PER device 210, it can be important to be able to detect fall events and minimize false positives (i.e., non-fall events that are detected as fall events). Consistent with aspects described herein, a classification model may be used to classify acceleration events as either fall events or non-fall events. The classification model may be dynamically updated, at PER devices 210, by classification server 230.

In one implementation, PER device 210 may analyze acceleration samples generated by accelerometers 310. A time series of acceleration values may be classified by PER device 210 based on a comparison of the magnitude of the acceleration values to a threshold. The magnitude of the acceleration values may be defined as the square root of the sum of the squares of the three acceleration values (e.g., corresponding to the 3 orthogonal axes) generated by accelerometer 310.

Figure 4:
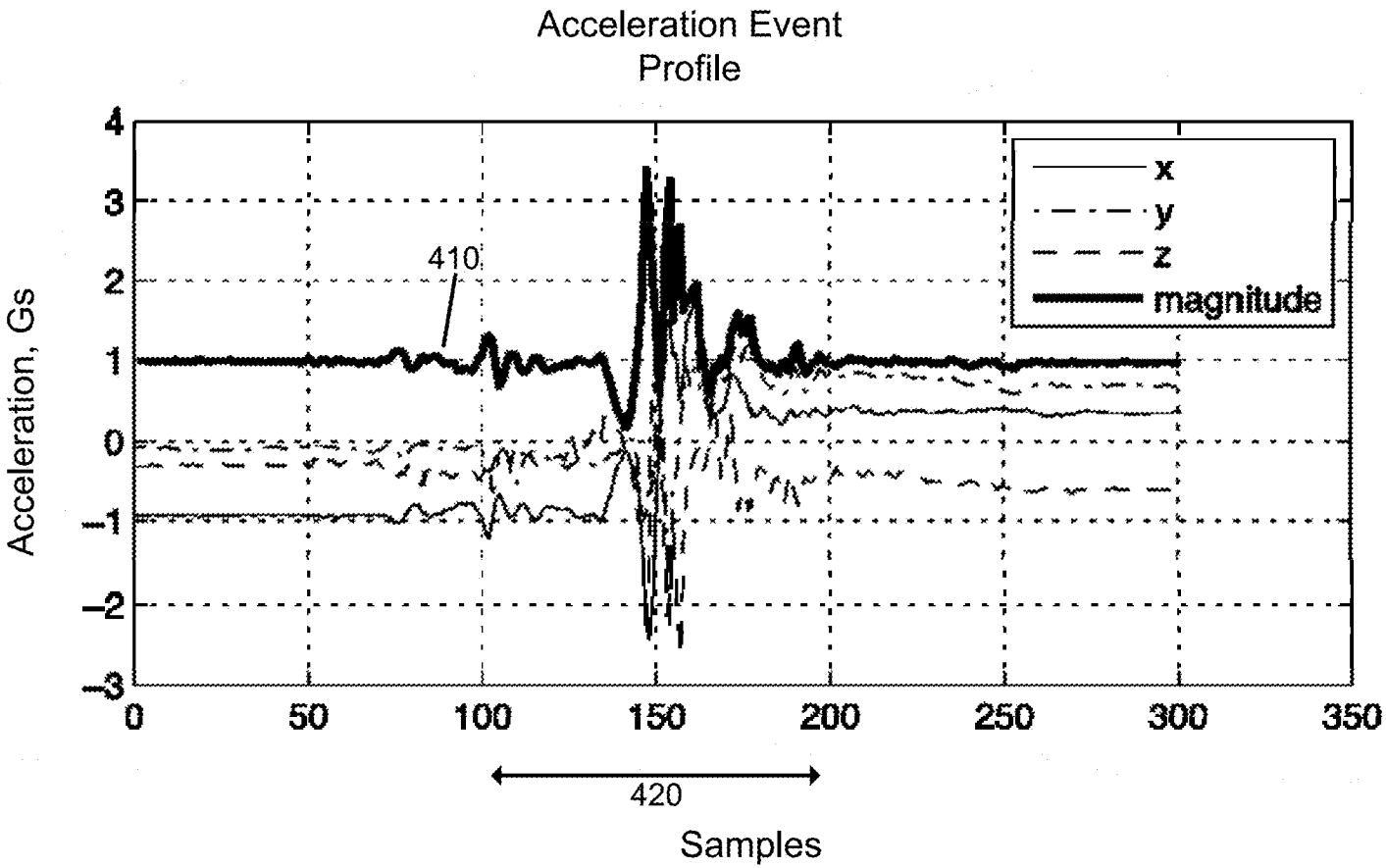
FIG. 4 is a diagram illustrating a graph of example acceleration values that may be determined by an accelerometer.

FIG. 4 is a diagram illustrating a graph of example acceleration values that may be sensed by accelerometer 310. In FIG. 4, example acceleration values corresponding to the X, Y, and Z axis are illustrated as curves plotted with respect to time. The combined magnitude of the X, Y, and Z curves (e.g., square root of the sum of squares magnitude) is illustrated as curve 410. In one implementation, an acceleration event may be detected when a certain minimum number or pattern of magnitude values varies from a longer term mean by a threshold amount. In FIG. 4, for instance, time period 420 may be determined as the period (e.g., as a particular length of time or a particular number of measurements) corresponding to an acceleration event.

As previously mentioned, the classification models discussed herein may be trained based on device-specific data (e.g., PER device 210) and/or user-specific data. The device-specific data and user-specific data may be maintained by classification server 230 and/or another device.

FIGS. 5A and 5B are diagrams illustrating example data structures 500 and 550, such as data structures that may be maintained by classification server 230 to store the device-specific data and user-specific data. In this example, each entry in data structure 500 may correspond to an acceleration event that was determined to correspond to a fall event. Similarly, each entry in data structure 550 may correspond to an acceleration event that was determined to correspond to a non-fall event.

As illustrated, data structure 500 may include a number of fields that store device-specific and user-specific data. The data in each field may be referred to as a "feature" of the corresponding acceleration event. The fields to include (i.e., the features to use to describe an acceleration event) may be determined by a designer of the system, through a combination of expert knowledge and learning techniques, or other techniques. In general, the features to include in data structure 500 may be selected to maximize the ability to correctly classify acceleration events as fall and non-fall events.

In the example of data structure 500, each acceleration event may be associated with: a maximum acceleration feature, features relating to energy over a particular sub-set (window) of the acceleration event ("Window 1 Energy" and "Window 2 Energy"), a post event activity feature, a feature defining the age of the user, a feature relating to the number of previous falls of the user, a feature relating to the number of previous false positives that were generated for the user, a feature relating to medical conditions associated with the user, and a feature relating to assisted devices that are used by the user. In this example, the "Max Acceleration," "Window 1 Energy," "Window 2 Energy," and "Post Event Activity" features may correspond to device-specific data. The "Age," Previous Falls," "Previous False Positives," "Medical Conditions," and "Assisted Devices" features may correspond to user-specific data.

The maximum acceleration feature may include a value defining the maximum acceleration experienced during the acceleration event. The window energy features may correspond to energy associated with the acceleration event. For example, "Window 1 Energy" may correspond to a total amount of energy calculated from the beginning of the acceleration event to the point of maximum acceleration in the acceleration event and "Window 2 Energy" may correspond to a total amount of energy calculated from the point of maximum acceleration in the acceleration event to the end of the acceleration event. The post activity feature may include a value measuring (e.g., on a scale of 0-5) an amount of acceleration activity over a time period (e.g., five seconds) after the acceleration event.

The feature relating to the user's age may be the age of the user associated with the acceleration event, the feature relating to previous falls may store a number of previous falls of the user associated with the acceleration event, and the feature relating to previous false positives may store a number of previous false positives of the user associated with the acceleration event. Similarly, the feature relating to medical conditions may include information regarding one or more medical conditions of the user, and the feature relating to assistance devices may include an indication of any assistance devices that are used by the user.

Data structure 550 may store values corresponding to those stored by data structure 500. While example data structure 550 includes the same fields as included in example data structure 500, the records in data structure 550 may correspond to acceleration events that were determined to be non-fall events.

The features illustrated in data structures 500 and 550 are examples. In alternative possible implementations, different, fewer, or additional fields may be stored for each record. For example, a number of additional or alternative features may be stored for each acceleration event and used in the generation of classification models maintained by classification server 230. As an example, other acceleration-based features that may be stored for the acceleration events may include: maximum acceleration values, estimated slope from an observed maximum to minimum acceleration value, additional post-event activity metrics, an approximate area between acceleration vectors, standard deviation acceleration measurements, mean acceleration measurements, entropy of acceleration measurements, etc. Further, the device-specific data, in addition to acceleration data, may include data generated by barometric pressure sensors, gyroscopes, magnetometers, proximity sensors, or other sensors. Gyroscopes, for example, may allow for rotation-dependent features, such as a rotation rate in a total rotation in a given acceleration window. Pressure sensors may allow for the measurement of pressure changes before and after an acceleration event. The user-specific data may include any relevant information that they may be known about a user, such as weight, height, living arrangement information, gender, or other information.

The term "energy," as used herein (e.g., the energy over a particular period of an acceleration event, such as "Window 1 Energy" and "Window 2 Energy") may refer to spectral energy as used in the signal processing art. In one implementation, energy may be measured or estimated based on the square of acceleration. For example, the energy of an acceleration sample may be calculated as 0.5*a^2, where a refers to the value of the acceleration sample.

The term "entropy," as used herein, may refer to Shannon entropy. Entropy may generally refer to a measure of uncertainty in a random variable. Entropy may be measured, for example, in units of bits, nats, or bans. Entropy may be defined as, for example, $$H(X) = -\sum_{x \in X} p(x) \log p(x)$$

where p(x) is the probability of a certain outcome (e.g., the frequency of falls or non-falls divided by the total number of events), for all events included in the set X.

The classification models described herein, such as the classification models maintained by classification server 230 and transmitted to PER devices 210, may use a number of different types of classification techniques. In one implementation, the classification models may be particularly based on binary classification trees (BCTs).

A BCT may be used to determine whether a set of observations (e.g., the features illustrated in FIGS. 5A and 5B) corresponds to a binary target value (e.g., a fall or non-fall). In general, a BCT may be constructed using a divide and conquer technique, where each node of the BCT results in a binary decision. Each split (binary decision) criteria may be determined by individually considering the potential information gain resulting from each possible split. Information gain may be calculated using the metric of entropy.

Figure 6:
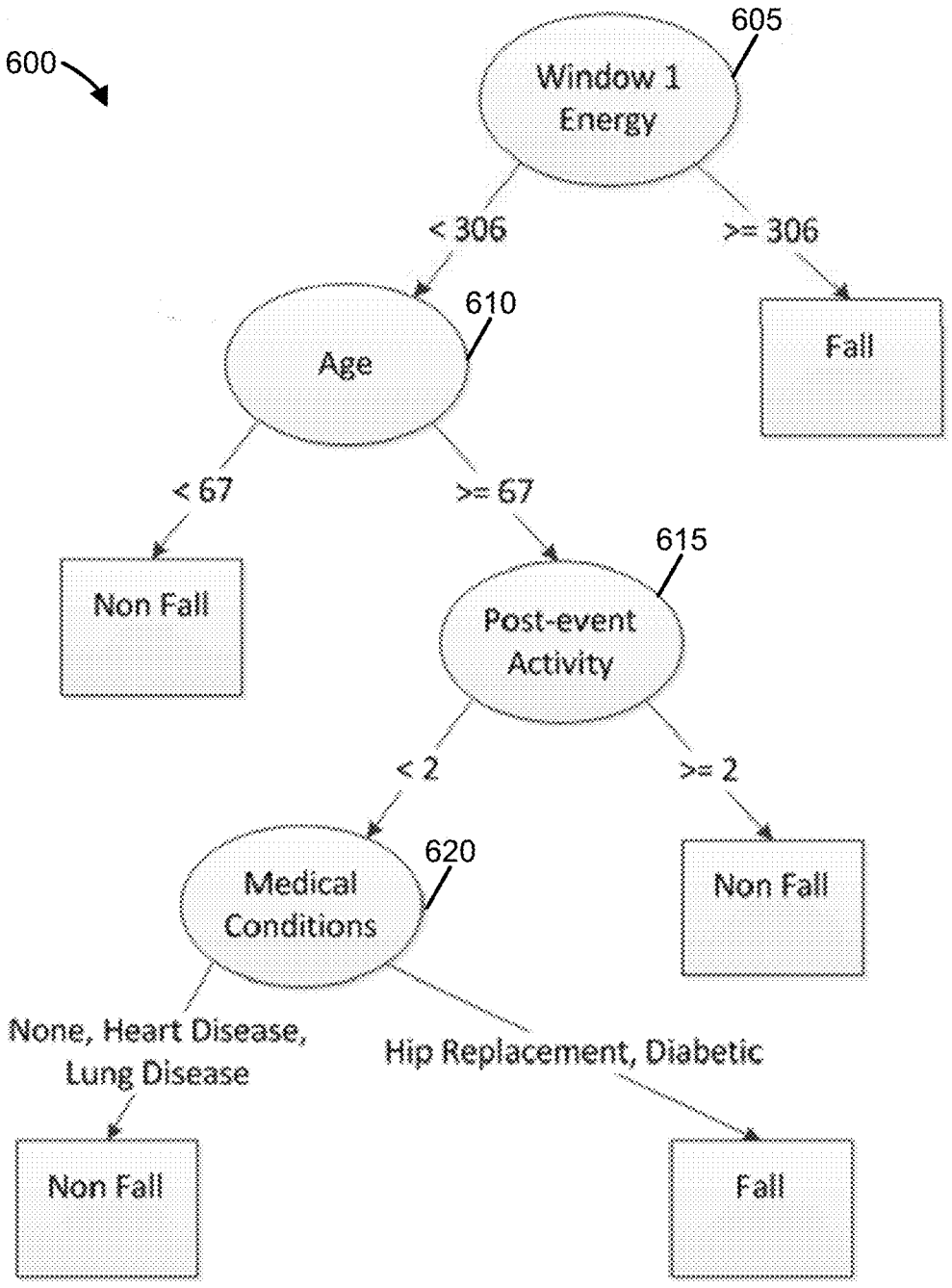
FIGS. 6 and 7 are diagram illustrating example binary classification trees.

FIG. 6 is a diagram illustrating an example BCT 600 that uses user-specific and device-specific data (e.g., the features illustrated in FIGS. 5A and 5B). BCT 600 may include a number of nodes 605-620 (shown as ovals). Each node 605-620 may be associated with one or more criteria that results in a binary decision. Training of BCT 600 (e.g., as performed by classification server 230) may include determining the nodes that make up BCT 600 and the criteria associated with each node. Run-time operation of BCT 600 (e.g., as performed by PER devices 210) may include traversing BCT 600, starting at the top level node 605, until a fall or non-fall decision (shown in rectangles) is reached.

In the example BCT 600, as shown in FIG. 6, node 605 may make a decision based on whether the energy of window 1 is less than 306. When the energy of window 1 is greater than or equal to 306, the acceleration event is immediately classified as a fall. Otherwise, in node 610, the age of the user is used such that if the age of the user is less than 67 the acceleration event is classified as a non-fall. Otherwise, in node 615, if a value relating to an amount of post-event activity is greater than or equal to two, the acceleration event is classified as a non-fall. Otherwise the medical conditions associated with the user are evaluated at node 620. In particular, as illustrated, the medical conditions "none," "heart disease," or "lung disease" result in the classification of non-fall while the medical conditions "hip replacement" or "diabetic" result in the classification of fall.

In some implementations, the BCT, such as BCT 600, may be trained to determine the number of nodes and the criteria corresponding to each node, based on known techniques for automatically training BCTs. Left unchecked, BCTs built from maximizing sequential information gain may become unwieldy and large, commonly referred to as overfitting. Overfitting may be mitigated by pruning, a process where nodes of the BCT are automatically removed. The pruning process may continue until a predicted error rate for the entire tree stops decreasing, decreases to a predetermined amount or percentage of all acceleration events, or decreases by a predetermined amount or percentage of all acceleration events. Pruning can also be conducted through expert opinion, such as where the final acceptance of a pruned BCT is controlled by human decision.

In some implementations, BCT performance can be further improved through cost functions, which allow the modification of error estimates to assign a higher weighting to either false positives or true negatives. In practice, falls that are not identified as such (true negatives) can be more costly than false positives, and may thus be assigned a higher weight to create a BCT that errs on the side of false positives.

In some implementations, classification server 230 may generate "general" BCTs that apply to all or most users of system 200. When BCTs are implemented on specific PER devices 210, the full complexity of the general BCT may not be needed, as the user-specific data for a particular user may indicate that particular nodes of the BCT will never be reached or may always result in the node resulting in a particular decision. In these situations, a user-specific BCT may be generated by eliminating branches/nodes, in the BCT, that are not applicable to the particular user.

Figure 7:
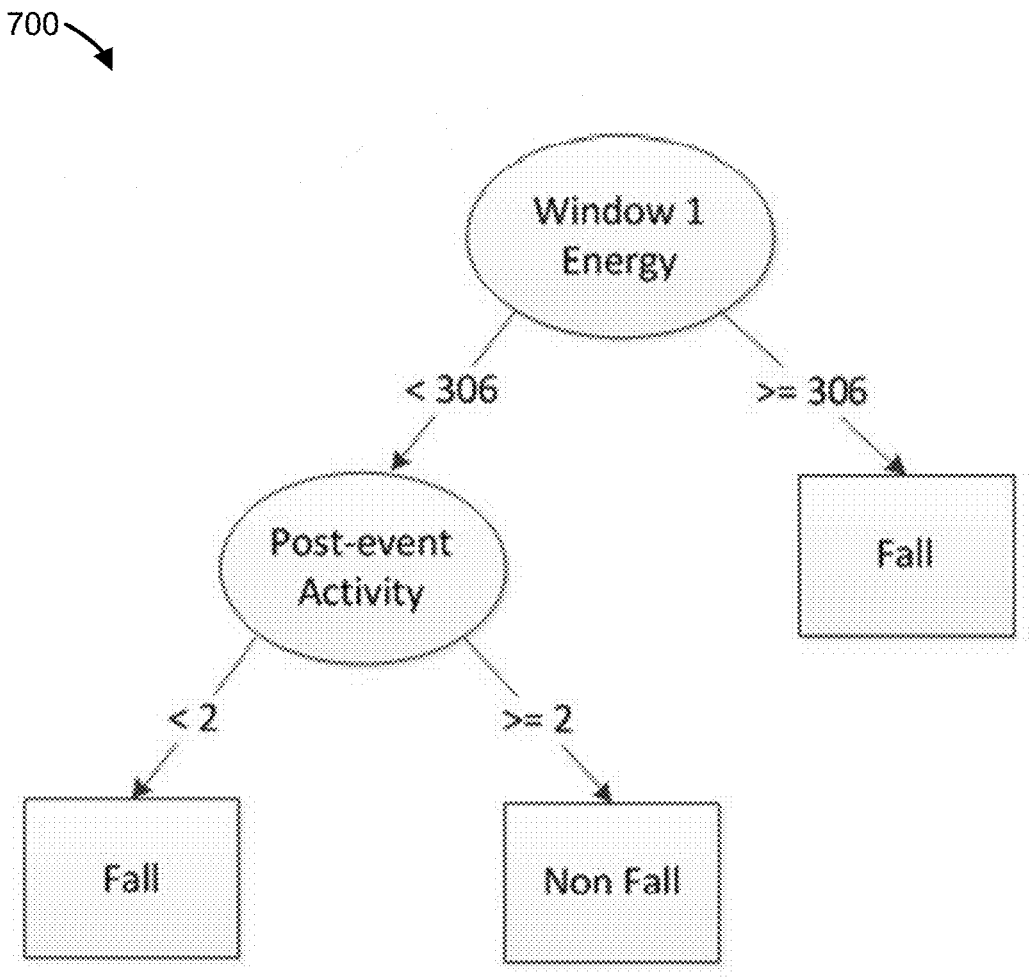

A user-specific version of BCT 600 in illustrated in FIG. 7 as BCT 700. BCT 700 may correspond to a version of BCT 600 that is tuned for a particular hypothetical user who is 70 years old and diabetic. As illustrated, tree 700 is a simplified version of tree 600 and does not include nodes 610 and 620, as these nodes are not necessary given known user-specific information. BCT 700 may be transmitted to the PER device 210 that corresponds to this particular user.

Figure 8:
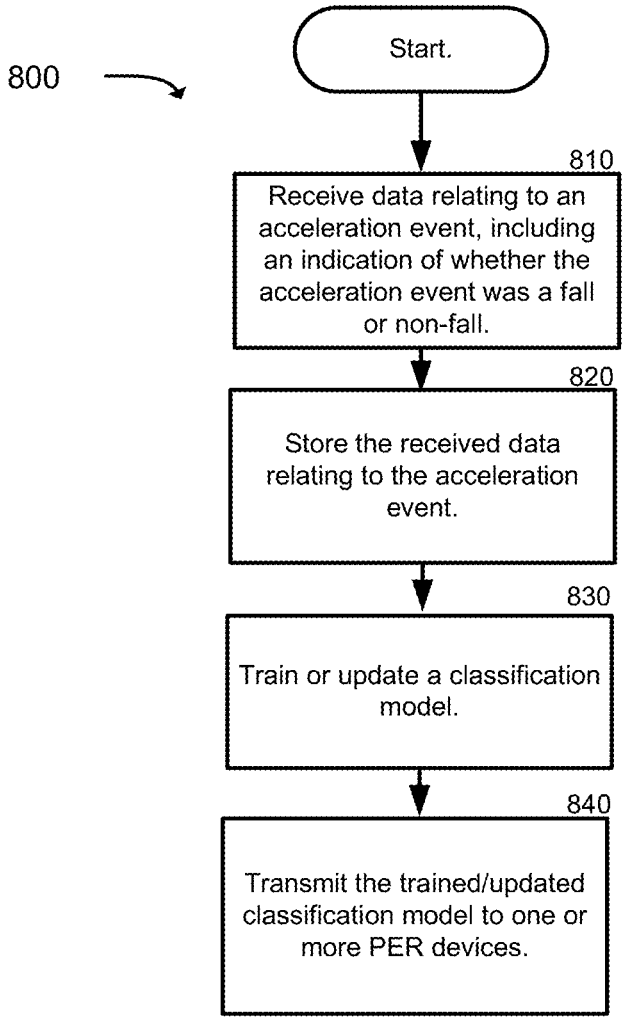
FIG. 8 is a flow chart illustrating an example process for adaptively creating classification models.

FIG. 8 is a flow chart illustrating an example process 800 for adaptive creation of classification models of fall detection. Process 800 may be performed, for example, by PER devices 210 and classification server 230.

Process 800 may include receiving data relating to an acceleration event, including an indication of whether the acceleration event was a fall or a non-fall (block 810). As mentioned, PER devices 210 may monitor acceleration experienced by the devices. When an acceleration event (e.g., as determined by a measured acceleration magnitude being above a threshold level for a minimum time period) is detected, PER device 210 may record data relating to the acceleration event, such as data relating to the measured acceleration values from accelerometer 310 and/or data obtained through other sensors 330. As discussed previously, the data relating to the acceleration event may include a number of features (representations of the data) that are determined ahead of time to potentially be useful to classify the acceleration event as a fall or non-fall. PER devices 210 may transmit, such as via a wireless network (e.g., network 220), the data relating to the acceleration event to classification server 230. For example, each PER device 210 may transmit data relating to an acceleration event when (or soon after) the acceleration event is detected. In some implementations, only data corresponding to acceleration events that are determined as a fall event, by the current classification model of the PER device, may be transmitted to classification server 230 (e.g., without sending data that has been determined to correspond to a non-fall event).

The data relating to the acceleration events, as received by classification server 230, may be associated with an indication of whether the acceleration event was an actual fall or non-fall event. As previously mentioned, PER devices 210 may visually or audibly indicate when a fall is detected. A user of the PER device may actuate cancel button 360 when a detected fall is not actually a fall. Thus, in this example, the user's explicit cancellation of the detected fall may indicate that the acceleration event is a non-fall. As another example, when a fall is detected by a PER device 210, a telephone call may be initiated to an emergency operator, who may speak to the user to determine whether the user needs assistance. The emergency operator may indicate, to classification server 230, whether the acceleration event is a fall or a non-fall.

Process 800 may further include storing the received data relating to the acceleration event (block 820). Classification server 230 may, for example, store the data relating to the acceleration event in a data structure similar to the data structures illustrated in FIGS. 5A and 5B. In one implementation, data corresponding to acceleration events that were determined to be falls may be stored in a first data structure or database, data corresponding to acceleration events that were determined to be non-falls may be stored in a second data structure or database, and the user-specific data may be stored in a third data structure or database. The user-specific data may be obtained directly from the users, such as during an initial registration or purchase of PER devices 210, or from some other source.

Process 800 may further include training or updating a classification model (block 830). The classification model may be trained based on the stored fall data, non-fall data, and user-specific data. In one implementation, the classification model may include a BCT. An implementation of block 830, in which the classification model includes a BCT, is discussed in more detail below with reference to FIG. 9.

The trained/updated classification model may be transmitted to one or more PER devices 210 (block 840). In one implementation, the trained/updated classification model may be transmitted to PER devices 210, via network 220, whenever the trained/updated classification model is determined to provide a threshold level of improvement over a previous version of the classification model. PER devices 210 may receive the classification model and update the classification model at the PER device. In this manner, the classification model used by PER devices 210 may be updated to take advantage of newer training data. In some implementations, the classification model that is transmitted to each PER device 210 may be customized, based on the user-specific data, corresponding to the PER device (e.g., as illustrated in FIG. 7).

The actual technique used to update the classification model at each PER device 210 may be performed in a number of ways. For example: threshold values corresponding to the nodes for the nodes in the classification model (e.g., when the classification model is a BCT) may be updated; threshold values and structure of the nodes may be updated; and/or a new or different model may be installed at PER device 210 (e.g., a neural network classification model may be installed in place of a BCT classification model).

Figure 9:
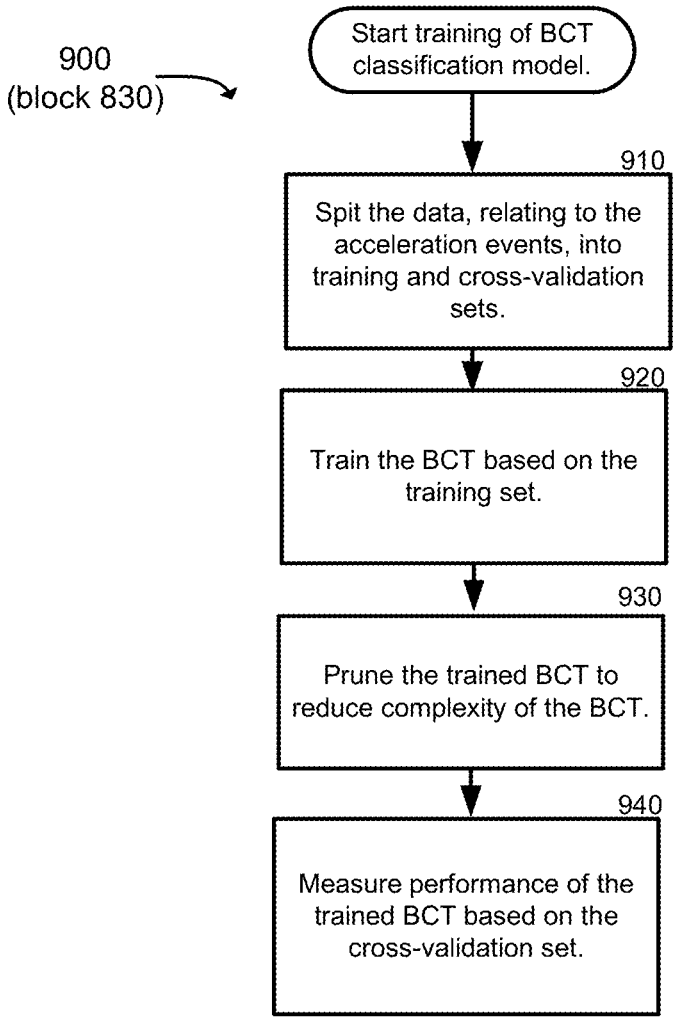
FIG. 9 is a flow chart illustrating an example process for training a classification model.

FIG. 9 is a flow chart illustrating an example process 900, such as a process corresponding to block 830 in FIG. 8, to train a classification model. In the example of FIG. 9, the classification model is particularly illustrated as a BCT. Process 830 may be performed, for example, by classification server 230.

Process 900 may include splitting the data, relating to the acceleration events, into training and cross-validation sets (block 910). In one implementation, a certain portion of the data, corresponding to the fall and non-fall acceleration events, may be identified as cross-validation records. The remaining records may be identified as training records. For example, a randomly selected 30% (or another value) of the data may be included in the cross-validation set and the remaining portion (70%) of the records may be included in the training set. The cross-validation records may be used to evaluate performance of the trained BCT. In another possible implementation, the training and cross-validation sets may be determined by using newer data for the training set and older data for the cross-validation set.

Process 900 may further include training the BCT based on the records in the training set (block 920). In one implementation, the BCT may be automatically determined, from the training set, using BCT training techniques, such as techniques designed to generate a BCT based on potential information gain, as measured by entropy, resulting from the addition of nodes. For example, a BCT function may return a classification tree based on a set of input records, where each record includes values for one or more features (e.g., the features illustrated for data structures 500 and 550), and output responses (e.g., fall or non-fall).

Process 900 may further include pruning the trained BCT (block 930). In one implementation, pruning may be based on an objective relating to a certain level of complexity in the BCT. Complexity may be defined, for example, as a certain number of nodes (e.g., a number that is bound by a confidence estimate, or subject to expert (e.g., human) opinion). Pruning may be desirable to avoid overfitting the BCT to the training set. Overfitting may cause the BCT to function poorly when presented with new data that was not included in the training set.

Process 900 may further include measuring the performance of the trained BCT based on the cross-validation set (block 940). For example, the records in the cross-validation set may be input to the BCT, and the output of the BCT (i.e., prediction of fall or non-fall) may be compared to the known fall/non-fall result of the record. In this manner, statistics may be generated measuring a number of false positives, correct outputs, and true negatives. Thresholds can be set, based on these statistics, to determine whether the trained BCT is more accurate than the current version of the BCT. For example, in one implementation, the trained BCT may be determined to be better than the current version of the BCT when the portion of true negatives and false positives is below the portion of true negatives and false positives that are generated by the current version of the BCT when run on the cross-validation set.

As previously mentioned, the trained BCT may be updated, at PER devices 210, when the newly trained version of the BCT is determined to be better than the current version of the BCT. In some implementations, when a trained BCT is generated in which the performance of the BCT, based on the cross-validation set, is below minimum performance thresholds, process 900 may be repeated to generate a new BCT.

Figure 10:
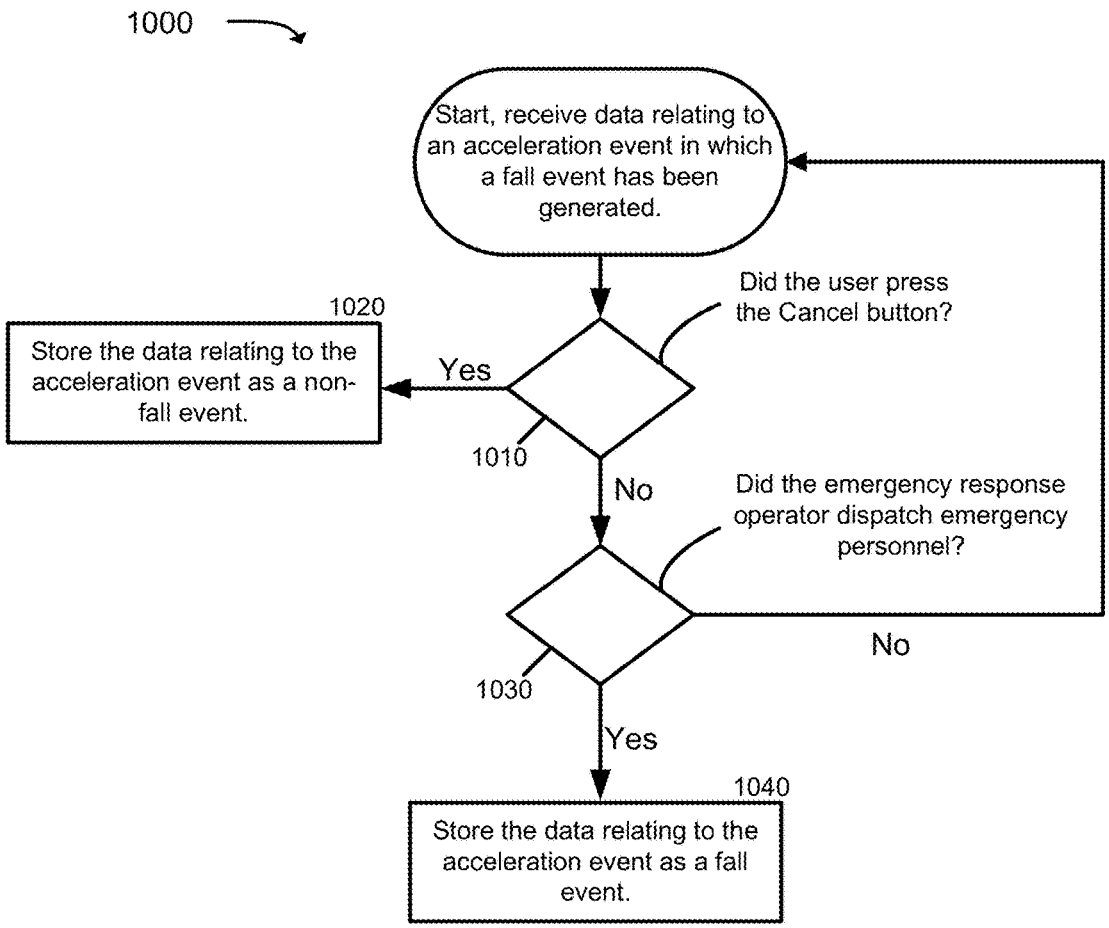
FIG. 10 is a flow chart illustrating an example process for receiving and storing data relating to an acceleration event.

FIG. 10 is a flow chart illustrating an example process 1000, such as a process corresponding to blocks 810 and 820 in FIG. 8, for receiving and storing data relating to an acceleration event. Process 830 may be performed, for example, by classification server 230.

As illustrated, process 1000 may be performed when PER device 210 detects an acceleration event and classifies the acceleration event as a fall event. In this situation, PER device 210 may transmit the data, relating to the acceleration event, to classification server 230. Process 1000 may include determining whether the user actuated the cancel button (block 1010). As previously discussed, cancel button 360 may be actuated by the user to cancel emergency services in response to a fall event that is detected by PER device 210. Pressing cancel button 360 may, for example, notify an emergency response operator of emergency response personnel should not be contacted. When the cancel button is determined to have been actuated (block 1010—YES), process 1000 may further include storing the data relating to the acceleration event as a non-fall event (block 1020). Classification server 230 may thus store the data relating to the acceleration event with an indication that the acceleration event corresponds to a non-fall.

Process 1000 may further include, when the cancel button is not actuated (block 1010—NO), determining whether the emergency response operator dispatched emergency personnel (block 1030). When emergency response personnel were dispatched (or the emergency response operator in some other way indicates that a fall was experienced by the user), process 1000 may include storing the data relating to the acceleration event as a fall event (block 1040). Classification server 230 may thus store the data relating to the acceleration event with an indication that the acceleration event corresponds to a fall.

As illustrated in the implementations of process 1000, data relating to an acceleration event may only be stored when the acceleration event was classified by the current classification model (e.g., by the PER device) as a fall event and when the fall event classification was definitively determined to be correct (block 1040) or incorrect (block 1020). In an alternative possible implementation, data may be stored when the data corresponds to an acceleration event and is initially classified, by the classification model as a non-fall event.

The classification models described above may implement a tradeoff between device-specific and user-specific data. This tradeoff may tend to create more robust classification models that allow for the identification of users that have a high risk of falling. In general, users at high risk may have user-specific data similar to other user that have experienced falls in the past. The classification models described above, such as the BCT, may operate to apply less sensitive tests to high-risk users, which may reduce the risk of misclassified falls. In some situations, it may be beneficial to further monitor high-risk users to further reduce the risk of misclassified falls.

Figure 11:
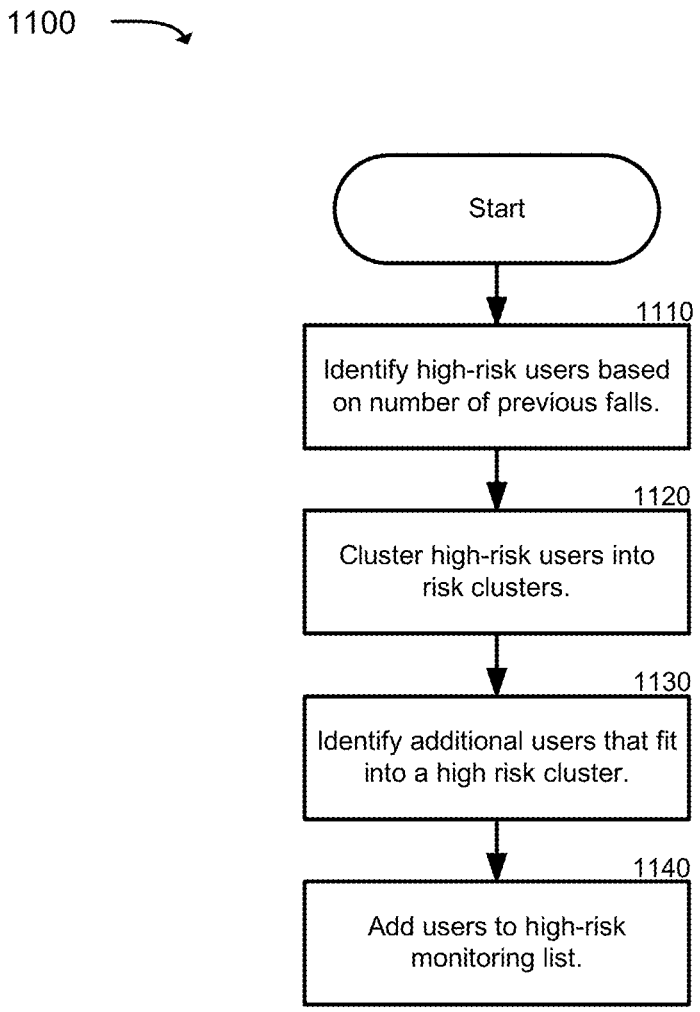
FIG. 11 is a flow chart illustrating an example process for identifying users who have a high risk of falling.

FIG. 11 is a flow chart illustrating an example process 1100 for identifying users that have a high risk of falling. Process 1100 may be performed, for example, by classification server 230.

Process 1100 may include identifying high-risk users based on a number of previous falls, or number of previous falls per given time period (block 1110). For example, users who have already experienced a number of validated falls greater than or equal to a predetermined threshold may be identified as high-risk users. The high-risk users, identified in block 1110, may be clustered (block 1120). The clustering may include clustering into as many separate clusters as necessary, as all high-risk users may not share a similar profile. Clustering techniques, such as the k-means algorithm, which seeks to iteratively minimize the distance between each cluster centroid and the members of that cluster, are known and may be used. When clustering, the discrete user specific-data, such as assistive devices, may be assigned a weighting value in order to compute Euclidean distances needed by the k-means algorithm. For example, one potential weighting for assistive devices could be: none—0, cane—1, walker—2, scooter—3. In this way, users assisted by a scooter are numerically more similar to users assisted by a walker than users needing no assistance.

Process 1100 may further include identifying additional users that fit into a high risk cluster (block 1130). The additional users may be users that have not fallen but that have user-specific data that corresponds to a high-risk cluster. If a given user fits within a high-risk cluster (e.g., by exhibiting a Euclidean distance from a high-risk cluster centroid below a predetermined threshold), then the user may be determined to be similar enough to other high-risk users to be considered to be a high-risk user. The users identified in block 1130 may be added to a high-risk monitoring list (block 1140). In some implementations, whether a user is on the high-risk monitoring list may be used as a feature when training the classification model.

In the process of building adaptive classification models, spurious data may be inadvertently collected. The spurious data may degrade the performance of the classification model. Before training the classification model, the fall and non-fall data may be processed to remove spurious data. In some implementations, the fall and non-fall data may first be clustered as a technique to remove spurious data.

Figure 12:
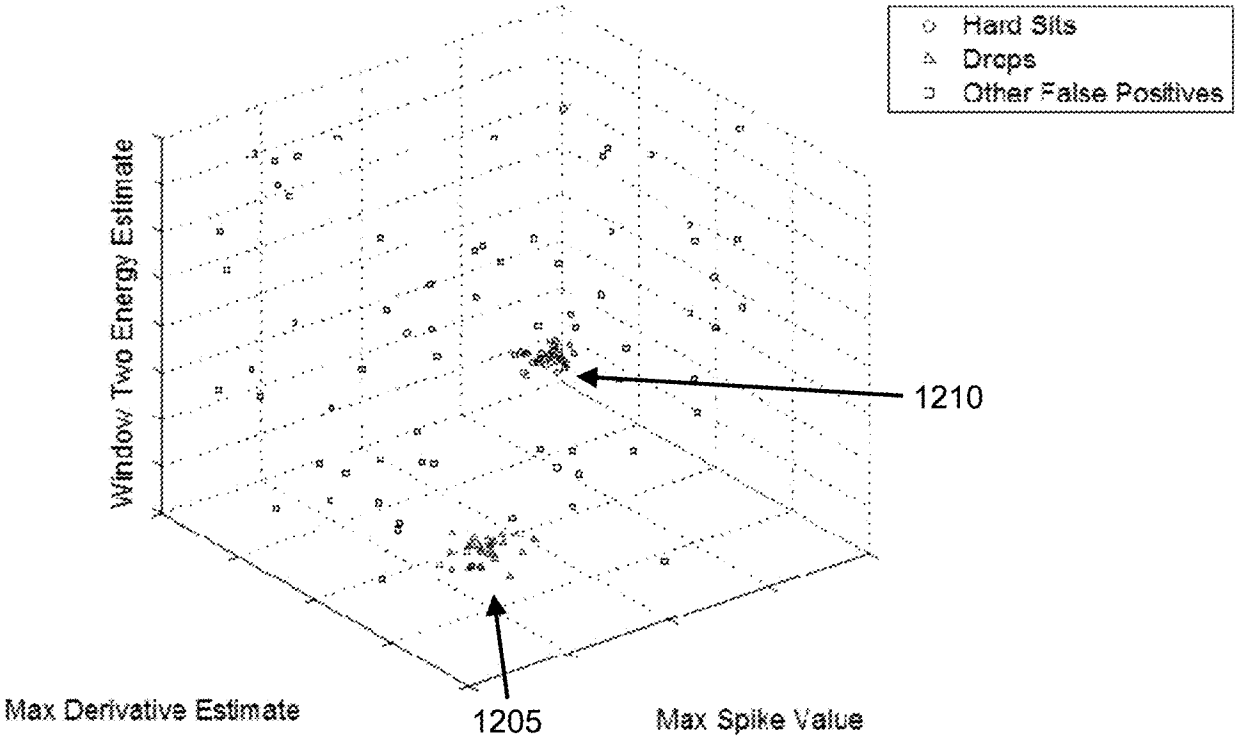
FIG. 12 is a diagram illustrating an example of clustering.

FIG. 12 is a diagram illustrating an example clustering process, where a dataset of false positives is separated into three groups by clustering, corresponding to drops, hard sits, and other false positives. The example of FIG. 12 corresponds to a three dimensional feature set for visualization purposes only—clustering may be applied in any dimensional feature space. As illustrated, a cluster 1205, which may correspond to a cluster of drops (e.g., a situation in which PER device 210 is dropped by the user) and a cluster 1210, which may correspond to a cluster of hard sits, may be identified. In some implementations, data points that do not correspond to an identified cluster may be removed from the training data set as spurious data.

Figure 13:
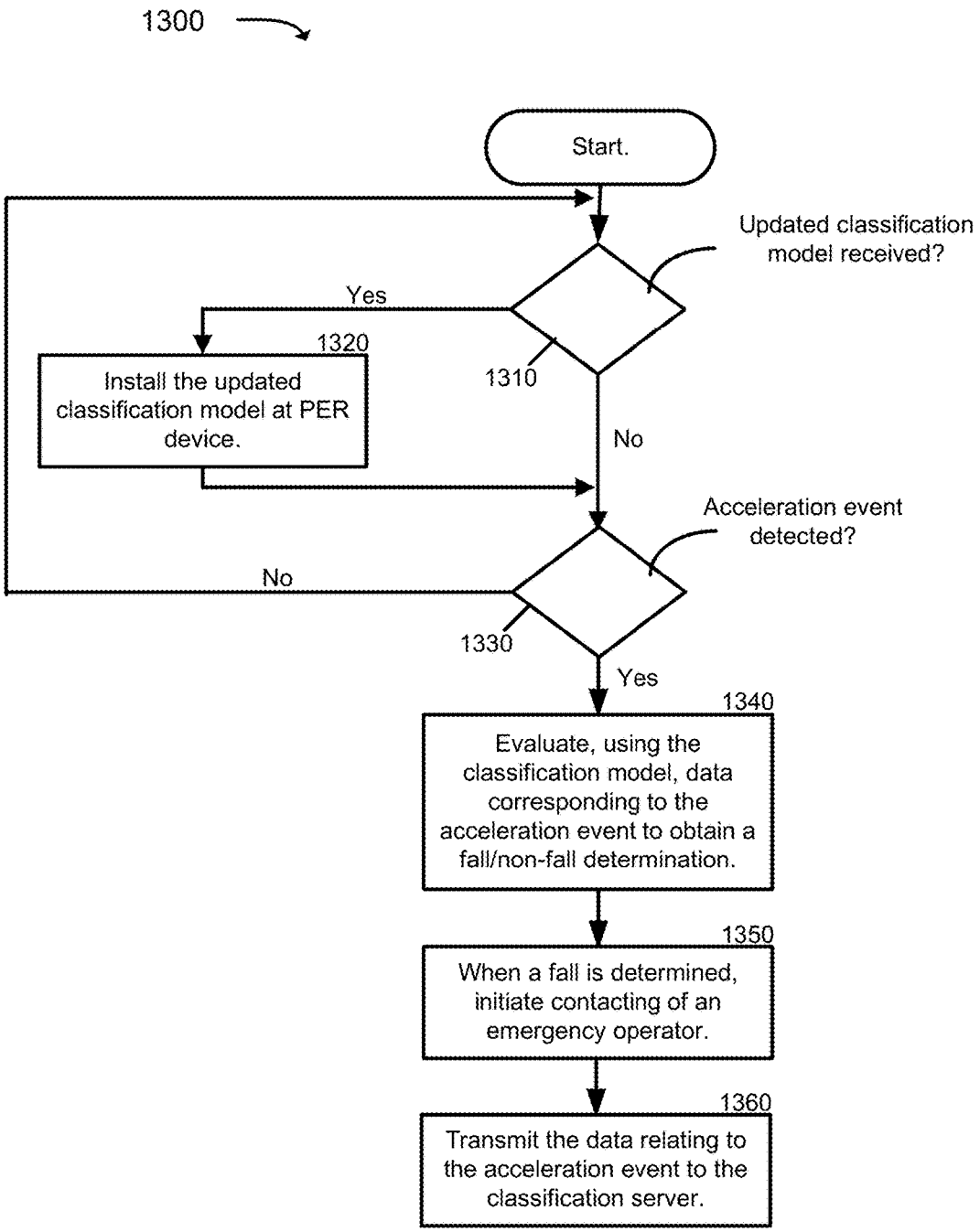
FIG. 13 is a flow chart illustrating an example process for operating a PER device.

FIG. 13 is a flow chart illustrating an example process 1300 for operating a PER device. Process 1300 may be implemented by PER devices 210.

Process 1300 may include determining whether an updated classification model is received (block 1310). As mentioned, classification models may be transmitted, from classification server 230, to PER devices 210. In some implementations, and as previously mentioned, the classification models may be customized based on the user-specific data of the user of each PER device 210. When the updated classification model is received by the PER device (block 1310—YES), the updated classification model may be installed by the PER device (block 1320).

Process 1300 may further include determining whether an acceleration event is detected (block 1330). Detection of an acceleration event, as previously mentioned, may occur when the acceleration magnitude, from accelerometer 310, is above a threshold for a predetermined time period.

When an acceleration event is detected (block 1330—YES), process 1300 may include evaluating, using the current classification model that is implemented by the PER device, data corresponding to the acceleration event to obtain a fall/non-fall determination (block 1340).

Process 1300 may further include, when a fall is determined, initiating contacting of an emergency operator (block 1350). For example, a telephone call to emergency response component 240 may be automatically placed. An emergency response operator, at emergency response component 240, may then determine whether to summon emergency response personnel for the user. PER device 210 may additionally indicate to the user, such as via an audible and/or visual indication, that a fall event was detected. If the user does not need assistance, the user may press cancel button 360 to cancel the emergency response process.

Process 1300 may further include transmitting the data relating to the acceleration event to the classification server (block 1360). For example, in some implementations, data relating to the acceleration event may be transmitted to classification server 230 whenever acceleration event is determined, by PER device 210, to be a fall event. In another possible implementation, data relating to all acceleration events, whether the acceleration events were determined to be fall or non-fall events, may be transmitted to classification server 230. Other information may also be transmitted to classification server 230, such as an indication of whether the user pressed cancel button 360.

In the description above, a classification model, trained by classification server 230, was described as being transmitted to PER devices 210 for run-time operation. In an alternative possible implementation, PER devices 210 may use a remote service (e.g., at classification server 230) to obtain run-time determinations of whether an acceleration event should be classified as a fall or non-fall event. In this implementation, data relating to each detected acceleration event may be transmitted to the remote service for the determination of whether the acceleration event is a fall or non-fall event.

Figure 14:
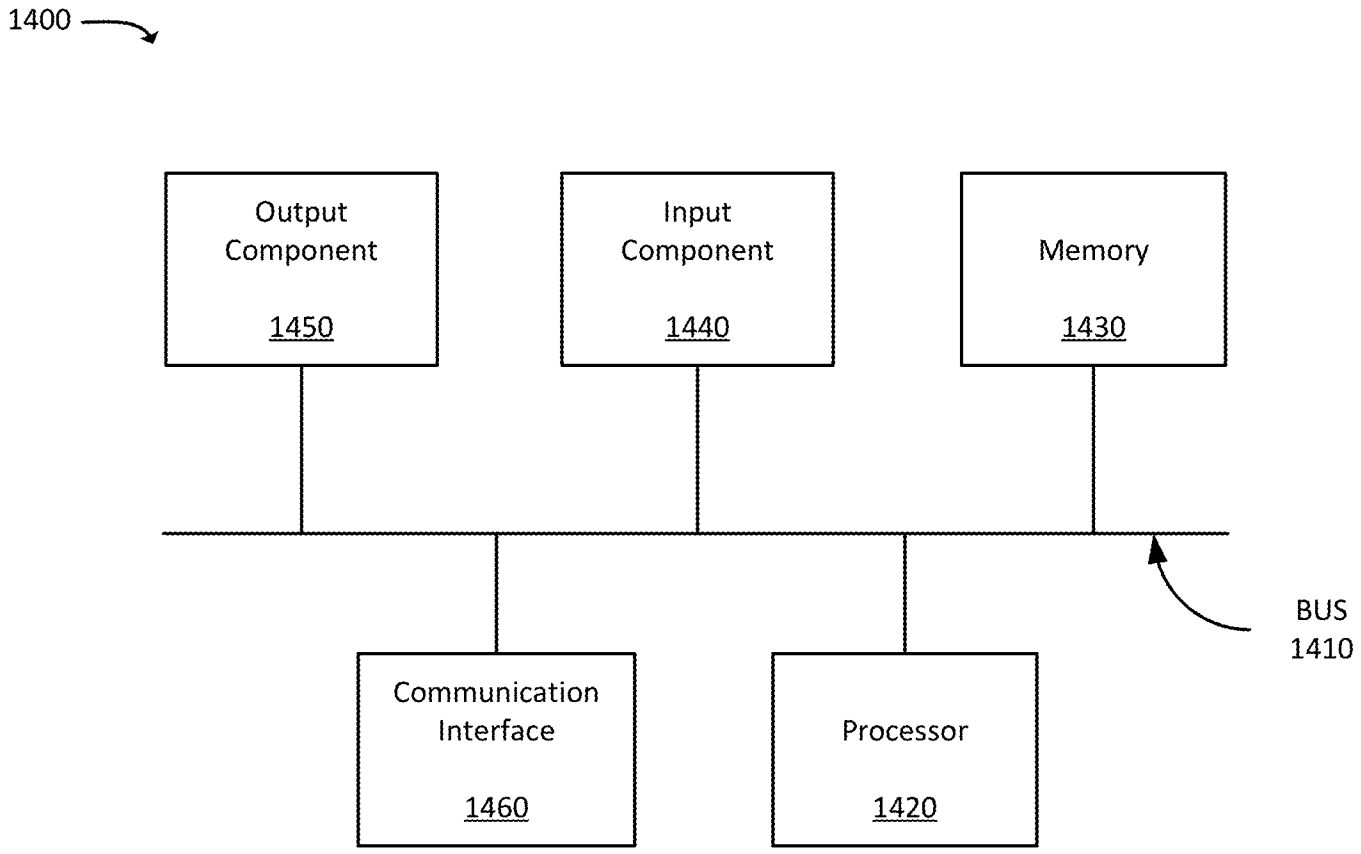
FIG. 14 is a diagram of example components of a device.

FIG. 14 is a diagram of example components of a device 1400. The devices illustrated in FIGS. 1-3 may include one or more devices 1400. Device 1400 may include bus 1410, processor 1420, memory 1430, input component 1440, output component 1450, and communication interface 1460. In another implementation, device 1400 may include additional, fewer, different, or differently arranged components.

Bus 1410 may include one or more communication paths that permit communication among the components of device 1400. Processor 1420 may include a processor, microprocessor, or processing logic that may interpret and execute instructions. Memory 1430 may include any type of dynamic storage device that may store information and instructions for execution by processor 1420, and/or any type of non-volatile storage device that may store information for use by processor 1420.

Input component 1440 may include a mechanism that permits an operator to input information to device 1400, such as a keyboard, a keypad, a button, a switch, etc. Output component 1450 may include a mechanism that outputs information to the operator, such as a display, a speaker, one or more light emitting diodes ("LEDs"), etc.

Communication interface 1460 may include any transceiver-like mechanism that enables device 1400 to communicate with other devices and/or systems. For example, communication interface 1460 may include an Ethernet interface, an optical interface, a coaxial interface, or the like. Communication interface 1460 may include a wireless communication device, such as an infrared ("IR") receiver, a Bluetooth radio, or the like. The wireless communication device may be coupled to an external device, such as a remote control, a wireless keyboard, a mobile telephone, etc. In some embodiments, device 1400 may include more than one communication interface 1460. For instance, device 1400 may include an optical interface and an Ethernet interface.

Device 1400 may perform certain operations described above. Device 1400 may perform these operations in response to processor 1420 executing software instructions stored in a computer-readable medium, such as memory 1430. A computer-readable medium may be defined as a non-transitory memory device. A memory device may include space within a single physical memory device or spread across multiple physical memory devices. The software instructions may be read into memory 1430 from another computer-readable medium or from another device. The software instructions stored in memory 1430 may cause processor 1420 to perform processes described herein. Alternatively, hardwired circuitry may be used in place of or in combination with software instructions to implement processes described herein. Thus, implementations described herein are not limited to any specific combination of hardware circuitry and software.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

For example, while series of blocks have been described with regard to FIGS. 8-11 and 13, the order of the blocks may be modified in other implementations. Further, non-dependent blocks may be performed in parallel.

It will be apparent that example aspects, as described above, may be implemented in many different forms of software, firmware, and hardware in the implementations illustrated in the figures. The actual software code or specialized control hardware used to implement these aspects should not be construed as limiting. Thus, the operation and behavior of the aspects were described without reference to the specific software code—it being understood that software and control hardware could be designed to implement the aspects based on the description herein.

Further, certain portions of the invention may be implemented as "logic" that performs one or more functions. This logic may include hardware, such as an ASIC or a FPGA, or a combination of hardware and software.

Even though particular combinations of features are recited in the claims and/or disclosed in the specification, these combinations are not intended to limit the invention. In fact, many of these features may be combined in ways not specifically recited in the claims and/or disclosed in the specification.

No element, act, or instruction used in the present application should be construed as critical or essential to the invention unless explicitly described as such. Further, the phrase "based on" is intended to mean "based, at least in part, on" unless explicitly stated otherwise.

What is claimed is:

1. A method, implemented by one or more devices, comprising:

receiving, by the one or more devices and from a plurality of personal emergency response (PER) devices, data relating to acceleration events that occurred at the PER devices;

associating, by the one or more devices, the data relating to the acceleration events with indications of whether the data relating to the acceleration events corresponds to fall events of users of the PER devices;

training, by the one or more devices, a classification model based on the data relating to the acceleration events and the indications of whether the data relating to the acceleration events corresponds to the fall events;

customizing the classification model, based on user-specific data, for a particular user of the PER devices, the customization including removing nodes of the classification model that are determined, based on the user-specific data for the particular user, to not affect an output of the classification model for the particular user;

transmitting, by one or more devices, the customized classification model to at least some of the PER devices to update a previous version of the classification model at the at least some of the PER devices;

identifying high-risk users, out of a plurality of users associated with the PER devices, based on a number of previous fall events associated with one or more users, of the plurality of users;

performing a clustering operation based on the identified high-risk users; and determining additional high-risk users based on a result of the clustering operation.

2. The method of claim 1, wherein the training further includes:

associating the user-specific data with the data relating to each acceleration event; and training the classification model based additionally on the user-specific data, to obtain the customized classification models.

3. The method of claim 1, further comprising:

splitting the data relating to the acceleration events into a set of training data and a set of cross-validation data, wherein the training of the classification model is performed based on the set of training data.

4. The method of claim 3, further comprising:

testing an accuracy of the classification model, based on the set of cross-validation data, to determine whether the classification model satisfies a threshold level of accuracy, wherein the transmitting includes transmitting the classification model only when the testing indicates that the classification model satisfies the threshold level of accuracy.

5. The method of claim 4, wherein testing the accuracy of the classification model includes defining a first threshold level based on an acceptable portion of true negatives and a second threshold level based on an acceptable portion of false positives, the testing further including:

determining whether the classification model satisfies the first threshold and the second threshold.

6. The method of claim 1, wherein the classification model includes a binary classification tree (BCT).

7. The method of claim 6, further comprising:

pruning the BCT to reduce a complexity of the BCT.

8. The method of claim 1, wherein the data relating to the acceleration events includes:

first data derived based on the output of an accelerometer; and second data derived based on the output of at least one of a barometric pressure sensor, a gyroscope, a magnetometer, a proximity sensor, heart rate sensor, glucose sensor, audio sensor, altimeter sensor, blood oxygen sensor, photo diode sensor, infrared sensor, or temperature sensor.

9. The method of claim 8, wherein the first data includes at least one of a maximum acceleration value, a measurement of energy over a particular time period, an estimated slope from an observed maximum to minimum acceleration value, an approximate area beneath acceleration values, a standard deviation of acceleration measurements, a combination of two or more acceleration sensor readings, or an entropy of acceleration measurements; and the second data includes at least one of a pressure value, pressure statistic derived from combining two or more pressure value readings, gyroscopic statistic derived from combining two or more gyroscopic readings, values relating to orientation of the PER device, or a value relating to body temperature, a glucose level, a heart rate, or blood pressure of the user.

10. The method of claim 1, wherein the associating the data relating to the relating to the acceleration events, further includes:

receiving a first indication of whether a user activated a cancel button on a PER device; or receiving a second indication of whether emergency response personnel were dispatched to the user of the PER device; and using the first or second indication to determine whether the user experienced a fall event.

11. The method of claim 1, wherein removing nodes of the classification model includes removing nodes of a Binary Classification Tree (BCT) to tune the classification model for a particular user.

12. One or more devices comprising:

at least one processor; and a memory including instructions, that when executed by the at least one processor, cause the at least one processor to:

receive, from a plurality of personal emergency response (PER) devices, data relating to acceleration events that occurred at the PER devices;

associate the data relating to the acceleration events with indications of whether the data relating to the acceleration events corresponds to fall events of users of the PER devices;

train a classification model based on the data relating to the acceleration events and the indications of whether the data relating to the acceleration events corresponds to the fall events;

customize the classification model, based on user-specific data, for a particular user of the PER device, the customization including removing nodes of the classification model that are determined, based on the user-specific data for the particular user, to not affect an output of the classification model for the particular user;

transmit the customized classification model to at least some of the PER devices to update a previous version of the classification model at the at least some of the PER devices;

identify high-risk users, out of a plurality of users associated with the PER devices, based on a number of previous fall events associated with one or more users, of the plurality of users;

perform a clustering operation based on the identified high-risk users; and determine additional high-risk users based on a result of the clustering operation.

13. The one or more devices of claim 12, wherein the instructions to train the classification model additionally include instructions, that when executed by the at least one processor, cause the at least one processor to:

associate the user-specific data with the data relating to each acceleration event; and train the classification model based additionally on the user-specific data, to obtain the customized classification models.

14. The one or more devices of claim 12, wherein the memory additionally includes instructions, that when executed by the at least one processor, cause the at least one processor to:

split the data relating to the acceleration events into a set of training data and a set of cross-validation data, wherein the training of the classification model is performed based on the set of training data.

15. The one or more devices of claim 14, wherein the memory additionally includes instructions, that when executed by the at least one processor, cause the at least one processor to:

test an accuracy of the classification model, based on the set of cross-validation data, to determine whether the classification model satisfies a threshold level of accuracy, wherein the transmitting includes transmitting the classification model only when the testing indicates that the classification model satisfies the threshold level of accuracy.

16. The one or more devices of claim 15, wherein testing the accuracy of the classification model includes defining a first threshold level based on an acceptable portion of true negatives and a second threshold level based on an acceptable portion of false positives, wherein when testing the accuracy of the classification model, the memory additionally includes instructions, that when executed by the at least one processor, cause the at least one processor to:

determine whether the classification model satisfies the first threshold and the second threshold.

17. The one or more devices of claim 12 wherein the classification model includes a binary classification tree (BCT).

18. The one or more devices of claim 12, wherein the data relating to the acceleration events includes:

data derived based on the output of an accelerometer; and data derived based on the output of at least one of a barometric pressure sensor, a gyroscope, a magnetometer, a proximity sensor, heart rate sensor, glucose sensor, audio sensor, altimeter sensor, blood oxygen sensor, photo diode sensor, infrared sensor, or temperature sensor.

19. The one or more devices of claim 12, wherein removing nodes of the classification model includes removing nodes of a Binary Classification Tree (BCT) to tune the classification model for the particular user.

* * * * *